US011920603B2

(12) United States Patent
Grøtterud et al.

(10) Patent No.: US 11,920,603 B2
(45) Date of Patent: Mar. 5, 2024

(54) SYSTEM FOR PUMPING A FLUID AND METHOD FOR ITS OPERATION

(71) Applicant: FMC Kongsberg Subsea AS, Kongsberg (NO)

(72) Inventors: Helge Grøtterud, Kongsberg (NO); Terje Hollingsæter, Lommedalen (NO)

( * ) Notice: Subject to any disclaimer, the term of this patent is extended or adjusted under 35 U.S.C. 154(b) by 444 days.

(21) Appl. No.: 15/511,572

(22) PCT Filed: Sep. 15, 2015

(86) PCT No.: PCT/EP2015/071136
§ 371 (c)(1),
(2) Date: Mar. 15, 2017

(87) PCT Pub. No.: WO2016/041990
PCT Pub. Date: Mar. 24, 2016

(65) Prior Publication Data

US 2017/0260982 A1 Sep. 14, 2017

(30) Foreign Application Priority Data

Sep. 16, 2014 (NO) ..... 20141112

(51) Int. Cl.
*F04D 27/02* (2006.01)
*F04B 17/03* (2006.01)
(Continued)

(52) U.S. Cl.
CPC ..... *F04D 27/0223* (2013.01); *F04B 49/03* (2013.01); *F04B 49/065* (2013.01);
(Continued)

(58) Field of Classification Search
CPC ..... F04D 7/02–045; F04D 13/08; F04D 15/0011; F04D 15/02–0254;
(Continued)

(56) References Cited

U.S. PATENT DOCUMENTS 3,299,815 A 1/1967 Thaw
4,678,404 A 7/1987 Lorett et al.
(Continued)

FOREIGN PATENT DOCUMENTS

CA 2 586 674 A1 10/2007
WO WO 2005/026497 A1 3/2005

*Primary Examiner* — Alexander B Comley

(57) ABSTRACT

A method for operating a pump includes establishing a pump limit characteristics diagram by mapping a first system parameter (P1) as a function of a second system parameter (P2) to identify a permissible operating region of the pump; for each first system parameter value ($P1_0$), identifying a minimum allowable second system parameter value ($P2_0$); monitoring the first system parameter (P1) and identifying a minimum allowable second system parameter value ($P2_0$) corresponding to the monitored first system parameter value ($P1_m$); monitoring the second system parameter (P2) and comparing the monitored second system parameter value ($P2_m$) with the identified minimum allowable second system parameter value ($P2_0$); and regulating a control valve that controls fluid flow through a return line connecting the suction and discharge sides of the pump so that the monitored second system parameter value ($P2_m$) does not fall below the minimum allowable second system parameter value ($P2_0$).

8 Claims, 2 Drawing Sheets

(51) Int. Cl.

| | |
|---|---|
| ***F04B 49/03*** | (2006.01) |
| ***F04B 49/06*** | (2006.01) |
| ***F04B 49/08*** | (2006.01) |
| ***F04D 15/00*** | (2006.01) |
| ***F04D 15/02*** | (2006.01) |
| ***F04D 25/06*** | (2006.01) |
| ***F04D 27/00*** | (2006.01) |
| *F04B 15/02* | (2006.01) |
| *F04B 19/06* | (2006.01) |
| *F04B 47/06* | (2006.01) |
| *F04D 7/04* | (2006.01) |
| *F04D 13/08* | (2006.01) |
| *F04D 31/00* | (2006.01) |

(52) U.S. Cl.
CPC ..... *F04B 49/08* (2013.01); *F04D 15/0011* (2013.01); *F04D 15/0209* (2013.01); *F04D 25/06* (2013.01); *F04D 27/001* (2013.01); *F04D 27/0215* (2013.01); *F04B 15/02* (2013.01); *F04B 17/03* (2013.01); *F04B 19/06* (2013.01); *F04B 47/06* (2013.01); *F04B 2203/0201* (2013.01); *F04B 2203/0207* (2013.01); *F04B 2205/07* (2013.01); *F04D 7/04* (2013.01); *F04D 13/08* (2013.01); *F04D 31/00* (2013.01)

(58) Field of Classification Search
CPC ..... F04D 27/009–0238; F04D 49/035; F04D 49/06–065; F04D 49/24; F04D 27/001; F04D 27/02–0238; F04D 31/00; F04B 15/02; F04B 17/03; F04B 35/04; F04B 37/20; F04B 49/08; F04B 2203/0201; F04B 2203/0207; F04B 2205/07; F04B 19/06; F04B 47/06; F04B 49/03; F04B 49/06; F04B 49/065; F04B 2203/02027
USPC ..... 417/307–310, 440
See application file for complete search history.

(56) References Cited

U.S. PATENT DOCUMENTS

| | | | | |
|---|---|---|---|---|
| 5,508,943 | A * | 4/1996 | Batson | F04D 27/0207 700/287 |
| 6,663,349 | B1 | 12/2003 | Discenzo et al. | |
| 2002/0136642 | A1 | 9/2002 | Moller | |
| 2002/0162402 | A1 | 11/2002 | Henyan | |
| 2009/0151801 | A1 | 6/2009 | Gorman et al. | |
| 2009/0274565 | A1* | 11/2009 | White | F04D 27/0215 417/282 |
| 2009/0324382 | A1* | 12/2009 | Schmitz | F04D 27/001 415/1 |
| 2012/0014812 | A1* | 1/2012 | Blaiklock | F04D 27/001 417/26 |
| 2013/0272898 | A1 | 10/2013 | Toh et al. | |
| 2014/0219820 | A1* | 8/2014 | Koki | F04D 25/06 417/19 |
| 2016/0047392 | A1* | 2/2016 | Bernocchi | F04D 27/0246 415/1 |

* cited by examiner

SYSTEM FOR PUMPING A FLUID AND METHOD FOR ITS OPERATION

FIELD OF THE INVENTION

The present invention relates to a method of operating a system for pumping a fluid, which system comprises:

- a pump comprising a suction side and a discharge side,
- a motor for driving the pump, which motor is drivingly connected to the pump via a shaft,
- a return line providing a feed-back conduit for the fluid from the discharge side to the suction side, and
- a control valve controlling the flow of the fluid through the return line.

The present invention also relates to a system for pumping a fluid, comprising:

- a pump comprising a suction side and a discharge side,
- a motor for driving the pump, which motor is drivingly connected to the pump via a shaft,
- a return line providing a feed-back conduit for the fluid from the discharge side to the suction side,
- a control valve controlling the flow of the fluid through the return line, and
- a first sensor device for monitoring a first system parameter which is a function of the differential pressure across the pump.

In particular, the present invention relates to a method and a system for pumping a multi-phase fluid or a fluid having a variable density, e.g. a hydrocarbon fluid, in a subsea, topside or a land-based hydrocarbon production or processing facility or complex, e.g. in a hydrocarbon well complex, a hydrocarbon transport facility, or any other type of facility where hydrocarbons are handled.

In particular, the present invention relates to a method and a system for pumping a fluid comprising hydrocarbons in a subsea hydrocarbon production or processing facility or complex.

BACKGROUND

Basically, in a hydrocarbon production facility or complex, multiphase pumps are used to transport the untreated flow stream produced from oil wells to downstream processes or gathering facilities. This means that the pumps must be able to handle a well or flow stream containing from 100 percent gas to 100 percent liquid. In addition to hydrocarbons, the flow stream can comprise other fluids, e.g. water, and solid particles, e.g. abrasives such as sand and dirt. Consequently, hydrocarbon multiphase pumps need to be designed to operate under changing process conditions and must be able to handle fluids having varying gas volume fractions (GVF) and/or densities.

In conventional multi-phase fluid pumping systems, one or a plurality of system parameters are normally used to control one or a plurality of variable system parameters in order to keep the pump within a permissible operating region. The system parameters may, for example, comprise a parameter indicative of the differential pressure across the pump, e.g. the pump suction pressure, and the variable operating parameters may, for example, comprise the rotational speed of the pump and/or the flow of fluid through a feed-back conduit leading from the discharge side to the suction side of the pump.

The operational range of a pump is generally illustrated in a DP-Q diagram (cf. FIG. 1). In the DP-Q diagram, the differential pressure over the pump is mapped against the volumetric flow through the pump, and the permissible operating region within the DP-Q diagram is identified. The border between the permissible operating region and an impermissible operating region is defined by the so called pump limit characteristics curve. Under normal conditions, the pump is operated only in the permissible operating region. However, if the pump enters the impermissible region, a pumping instability, or surge, may occur, in which case the pump may be subjected to a possible failure.

During operation of the system, the differential pressure across the pump and the flow of fluid through the pump may be monitored. If the monitored operating point approaches the pump limit characteristics curve, a control valve controlling the flow of fluid through a feed-back conduit leading from the discharge side to the suction side of the pump may be opened, thereby securing a minimum flow of fluid through the pump.

However, due to the multi-phase character of the fluid flow, complex and expensive multi-phase flowmeters are normally required to monitor the flow of the fluid in a reliable way.

The present invention addresses this problem, and an object of the invention is to provide a new method for pumping multi-phase fluid without the need for multi-phase flowmeters.

Also, in hydrocarbon fluid pumping applications, the gas volume fraction (GVF) and/or the density of the fluid may change quickly, e.g. due to gas and/or liquid slugs in the system. On the other hand, the differential pressure requirements across the pump will normally change relatively slowly due to slow changes in the production profile. With large volumes of compressible fluid upstream and downstream of the pump, and assuming that slug lengths are shorter than the lengths of the flow lines, the differential pressure requirement will be fairly constant, even if the pump sees density variations. As a consequence, a conventional multi-phase fluid pumping system using the differential pressure across the pump as a main parameter to control the system may not be fast enough to prevent the pump from entering the inadmissible operating region.

The present invention also addresses this problem, and a further object of the invention is to provide a system for pumping a multi-phase fluid and a method of operating the same which can react quickly to a change in the gas volume fraction and/or the density of the fluid.

SUMMARY OF THE INVENTION

The method according to the invention comprises the steps of:

- establishing a pump limit characteristics diagram by mapping a first system parameter as a function of a second system parameter identifying a permissible operating region of the pump, wherein the first system parameter is a function of a differential pressure across the pump, and wherein the second system parameter is a function of the torque acting on the shaft,
- for each first system parameter value, identifying a minimum allowable second system parameter value,
- monitoring the first system parameter and identifying the minimum allowable second system parameter value corresponding to the value of the monitored first system parameter,
- monitoring the second system parameter and comparing the value of the monitored second system parameter with the identified minimum allowable second system parameter value, and regulating the control valve such that the value of the monitored second system parameter does not fall below the minimum allowable second system parameter value.

The system according to the invention is characterised in that it comprises:

a second sensor device for monitoring a second system parameter which is a function of the torque of the pump, and a control unit arranged to:

receive monitored first system parameter values from the first sensor device and, for each monitored first system parameter value, identify a minimum allowable second system parameter value, receive monitored second system parameter values from the second sensor device and, for each monitored second system parameter value, compare the monitored second system parameter value with the identified minimum allowable second system parameter value, and regulate the control valve such that the monitored second system parameter value does not fall below the minimum allowable second parameter value.

Consequently, according to the invention, a first system parameter, which is a function of the differential pressure across the pump, and a second system parameter, which is a function of the torque of the pump, are utilized within the framework of a minimum flow controller to prevent the pump from entering the impermissible region.

Instead of using a conventional minimum flow control, the present invention utilises a minimum torque control by identifying a parameter which is a function of the torque, i.e. the above-discussed second system parameter, and regulates the system based on this parameter. This makes measuring the flow through the pump redundant since sufficient flow through the pump is ensured as long as the pump torque is kept above a predefined minimum value which is a function of the differential pressure across the pump.

For each monitored first system parameter value, e.g. a monitored differential pressure value, a minimum allowable second system parameter value is identified, e.g. a minimum allowable torque value, which minimum allowable second system parameter value should not be undercut in order to safeguard sufficient flow through the pump. When operating the system, the first system parameter is monitored and the minimum allowable second system parameter value for the monitored first system parameter value is identified. The second system parameter is then monitored and compared to the minimum allowable second system parameter value, and sufficient flow through the pump is upheld by regulating the control valve of the feed-back conduit such that the monitored second system parameter does not fall below the minimum allowable second system parameter value.

The invention is applicable to subsea, topside and land-based multi-phase fluid pumping systems, e.g. hydrocarbon fluid pumping systems.

The first system parameter may advantageously be the differential pressure across the pump.

The second system parameter may advantageously be any one of a torque of the pump and a current in the windings of the motor.

The system may advantageously comprise a variable speed drive for operating the motor, and the step of monitoring the second system parameter may advantageously comprises sampling the second system parameter from the variable speed drive.

The step of identifying a minimum allowable second system parameter value may advantageously comprise compensating the minimum allowable second system parameter value for at least one of mechanical losses in the motor and electrical losses between the variable speed drive and the motor.

The step of regulating the control valve may advantageously comprise opening the control valve when the value of the monitored second system parameter approaches the minimum allowable second system parameter value.

In the following, embodiments of the invention will be disclosed in more detail with reference to the attached drawings.

DETAILED DESCRIPTION OF THE INVENTION

Figure 1:
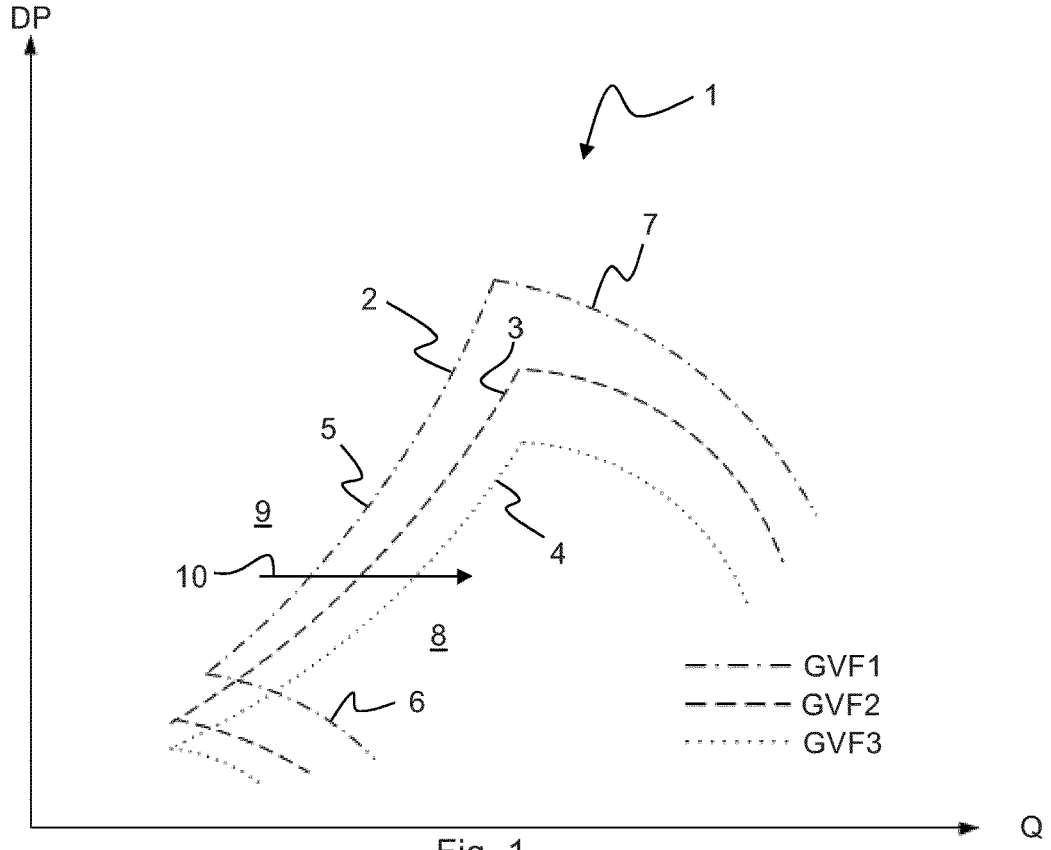
Fig. 1 (Prior Art)
FIG. 1 discloses a DP-Q diagram conventionally used to illustrate the operational range of a pump in a fluid pumping system.

FIG. 1 discloses a conventional pump limit characteristics diagram 1 for a hydrocarbon pump where the differential pressure DP across the pump is mapped as a function of the volumetric flow Q through the pump. This type of diagram is conventionally referred to as a DP-Q diagram. The diagram discloses a first pump limit characteristics curve 2 for a first gas volume fraction, GVF1, a second pump limit characteristics curve 3 for a second gas volume fraction, GVF2, and a third pump limit characteristics curve 4 for a third gas volume fraction, GVF3, of the hydrocarbon fluid, where GVF1<GVF2<GVF3. Each pump limit characteristics curve 2-4 comprises a minimum flow curve section 5, a minimum speed curve section 6 and a maximum speed curve section 7 defining a permissible operation region 8 and an impermissible operation region 9 of the pump. When the GVF is increased, it is necessary to increase the pump speed (and flow) in order to maintain the same torque. As is shown in the diagram 1, the operational point of the pump should be shifted when the gas volume fraction changes from GVF1 to GVF2 and then further to GVF3, as is indicated by the arrow 10.

Figure 2:
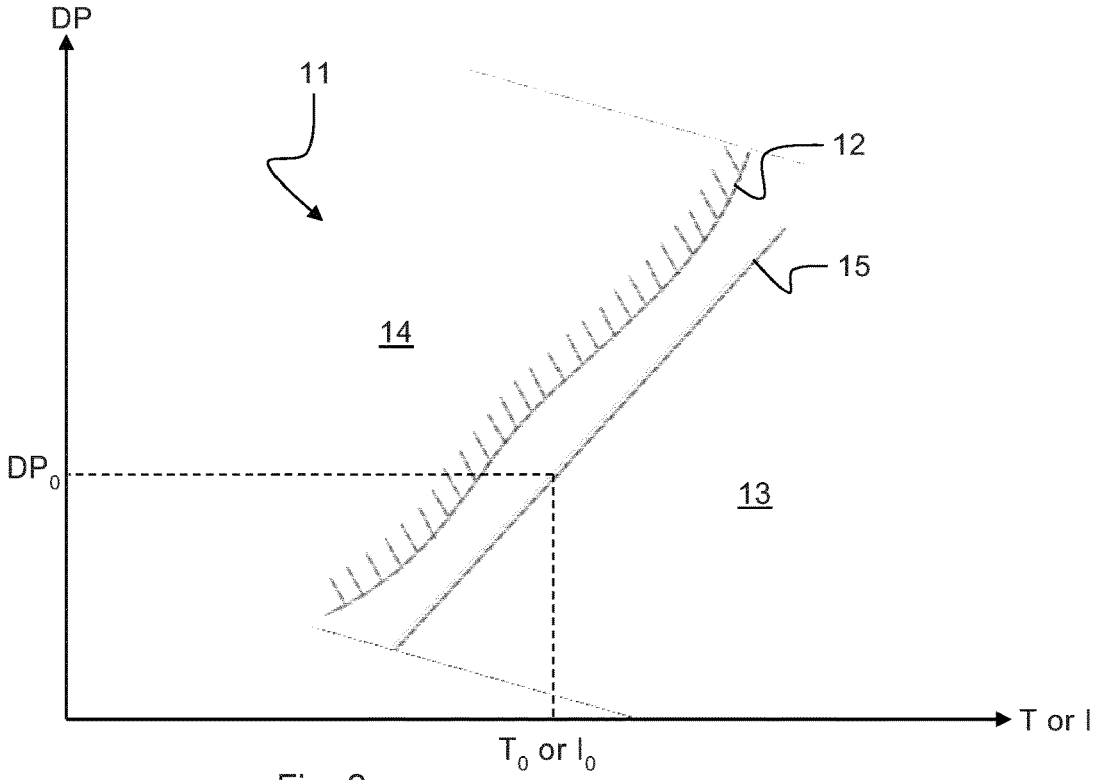
FIG. 2 discloses a diagram of an alternative, novel way of illustrating the operational range of a pump in a fluid pumping system.

FIG. 2 discloses an alternative pump limit characteristics diagram 11 for the pump where the differential pressure across the pump, DP, is mapped as a function of the pump torque T.

The manner of establishing a pump limit characteristics diagram as disclosed in FIG. 2 is beneficial since it has been revealed that the minimum pump torque required to uphold a sufficient differential pressure across the pump is valid for different gas volume fractions and fluid densities. Consequently, instead of requiring pump limit characteristics curves for different GVFs or densities, only one pump limit characteristics curve 12 needs to be established and stored in the system. Therefore, the pump limit characteristics curve 12 defines second system parameter values below which the pump may experience a pumping instability or surge, independent of the gas volume fraction and density of the fluid. The curve 12 separates a permissible operating region 13 from an impermissible operating region 14 of the pump. Consequently, for every differential pressure value, $DP_0$ ($P1_0$), it is possible to identify an allowable, desired torque value, $T_0$ ($P2_0$), thus establishing a pump operation curve 15 in the permissible operating region13 positioned at a predetermined, safe distance from the pump limit characteristics curve 12. Consequently, for each differential pressure value $DP_0$ ($P1_0$), the torque value $T_0$ ($P2_0$) may be used as a setpoint or target value for the torque, or as a minimum allowable torque value.

During normal operation of the pump, the motor current of the motor driving the pump, i.e. the current flowing in the windings of the pump motor, will generally be proportional to the pump torque. Consequently, instead of mapping the differential pressure against the torque, the differential pressure may alternatively be mapped against the winding current of the pump motor, I, as is indicated in FIG. 2.

The method of operating a fluid pumping system according to the invention comprises the step of establishing a pump limit characteristics diagram 11 of the type disclosed in FIG. 2 by mapping a first system parameter P1 as a function of a second system parameter P2 identifying a permissible operating region 13 of the pump, wherein the first system parameter P1 is a function of a differential pressure across the pump, and wherein the second system parameter P2 is a function of the torque acting on the pump shaft. As discussed above, the first parameter P1 may be the differential pressure measured across the pump, and the second system parameter P2 may be the torque T acting on the pump shaft or, alternatively, the motor current of the pump motor.

The method further comprises the step of identifying a minimum allowable second system parameter value $P2_0$ for each first system parameter value $P1_0$. The set of minimum allowable values $P2_0$ may be defined by the above-discussed pump operation curve 15. The set of minimum allowable second system parameter values $P2_0$ may, for example, comprise a minimum allowable pump shaft torque value, $T_0$, or a minimum allowable pump motor current value $I_0$ for every differential pressure value $DP_0$, as is indicated in FIG. 2.

Once established, the set of minimum allowable second system parameter values $P2_0$ are stored in the system to provide reference values during its operation.

Figure 3:
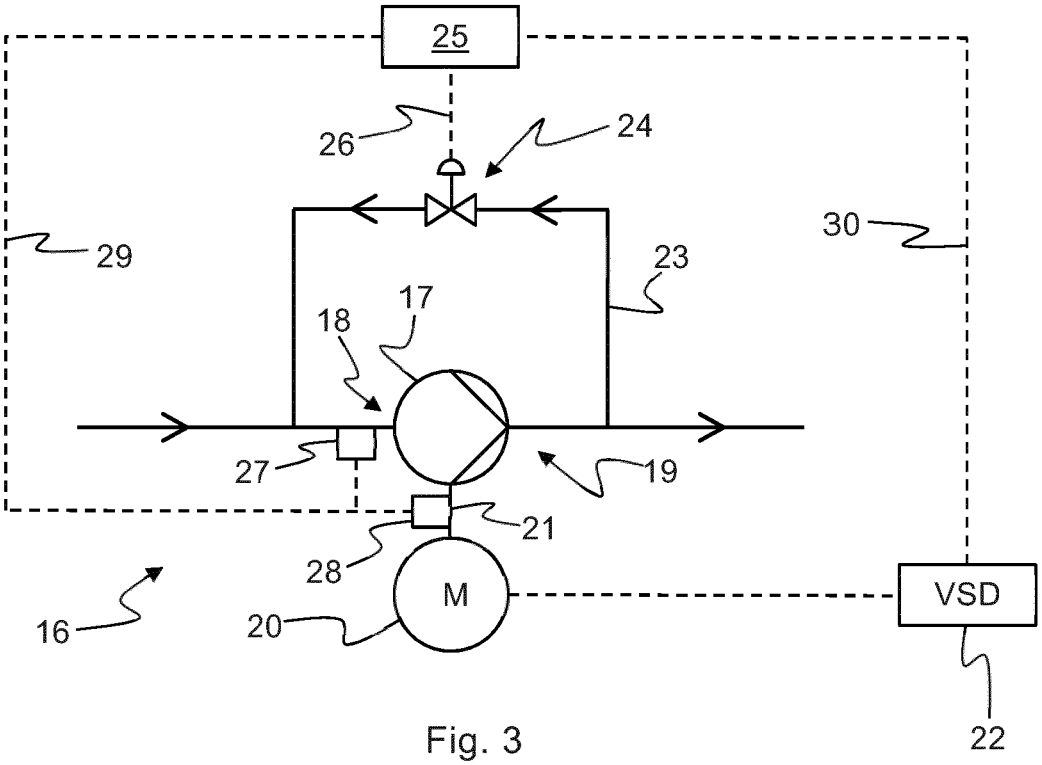
FIG. 3 discloses a hydrocarbon fluid pumping system according to an embodiment of the invention.

FIG. 3 discloses a hydrocarbon fluid pumping system 16 according to a preferred embodiment of the invention. The system comprises a pump 17 having a suction side 18 and a discharge side 19. The pump 17 may advantageously be a helicoaxial (HAP) or centrifugal type pump. The system 16 further comprises an electrical motor 20 for driving the pump 17 via a shaft 21. The motor 20 is a variable speed motor which is controlled by a variable speed drive, VSD 22. The system 16 also comprises a return line 23 providing a feed-back conduit for the hydrocarbon fluid from the discharge side 19 to the suction side 18 of the pump 17, and a control valve 24 controlling the flow of the hydrocarbon fluid through the return line 23. The system further comprises a control unit 25 providing control signals for the control valve 24 via a signal conduit 26.

In order to monitor the first parameter P1, i.e. the parameter indicative of the differential pressure across the pump 17, the system 16 comprises a first measuring or sensor device 27. This sensor device 27 may be a pressure sensor arranged to monitor the differential pressure DP across the pump 17.

Also, in order to monitor the second parameter P2, i.e. the parameter indicative of the pump torque, the system 16 comprises a second measuring or sensor device 28. The second sensor device 28 may be a torque sensor arranged to monitor the torque T acting on the shaft 21 or, alternatively, a current sensor arranged to monitor the motor current I.

The monitored first and second system parameter values are conveyed from the sensor devices 27, 28 to the control unit 25 via signal conduit 29.

When monitoring the second parameter P2, the most accurate parameter value is obtained by measuring the pump torque directly at the shaft 21. In subsea applications, however, this may not be a viable option since surface signal conduits may have bandwidth ratings ruling out efficient transfer of the torque signal. Therefore, it may be advantageous to sample the second parameter P2 from the variable speed drive 22. In the variable speed drive 22, signals indicative of the shaft torque are readily available. For example, the pump torque can easily be calculated from the power and the pump speed with the following function:

$$T=(P\cdot 60000)/(2\cdot\pi\cdot N)$$

where the torque T is given in Nm, the power P in kW and the pump speed N in rotations per minute.

Also, the signals of the variable speed drive 22 are sampled with a relatively high sampling frequency which makes it possible to realise a responsive control system. Furthermore, in subsea pumping systems, the variable speed drive is generally more accessible than the pump-motor assembly since the variable speed drive is normally positioned topside, i.e. above sea level.

If the second system parameter P2 is sampled from the variable speed drive 22, the monitored second system parameter values are advantageously conveyed from the variable speed drive 22 to the control unit 25 via signal conduit 30.

Figure 4:
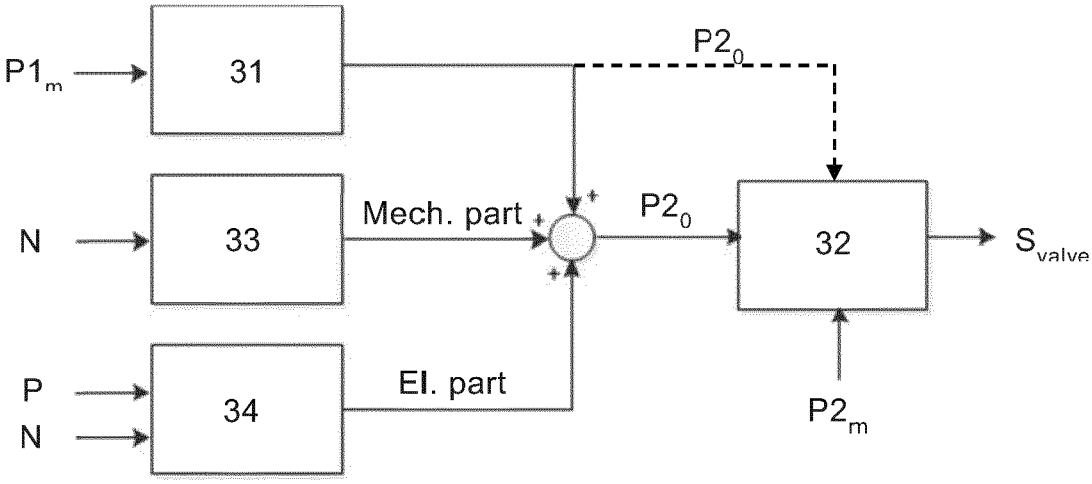
FIG. 4 is a block diagram schematically illustrating a method of regulating a hydrocarbon pumping system according to the invention.

In the following, a method of operating the system 16 will be discussed with reference to FIG. 4. The method comprises the step of monitoring the first system parameter P1 and, for each monitored first system parameter value $P1_m$, identifying the minimum allowable second system parameter value $P2_0$, e.g. using the above-discussed pump operation curve 15 (cf. FIG. 2). In FIG. 4, this step is illustrated by reference numeral 31. As discussed above, the first system parameter P1 may advantageously be a function of the differential pressure across the pump and the second system parameter value may advantageously be a function of the pump torque. The minimum allowable second system parameter value $P2_0$ may for example relate to the pump torque $T_0$ or to the motor current $I_0$, depending on which parameter is chosen as the second system parameter.

The method further comprises the step of monitoring the second system parameter P2 and, for each monitored second system parameter value $P2_m$, comparing the value with the previously identified minimum allowable second system parameter value $P2_0$. In FIG. 4, this step is illustrated by reference numeral 32. As is indicated by the dashed path in FIG. 4, the monitored second system parameter value $P2_m$ may be compared directly with the minimum allowable second system parameter value $P2_0$. However, if the second system parameter P2 is sampled from the variable speed drive 22, mechanical losses in the motor and electrical losses in cables and transformers between the variable speed drive and the motor may advantageously be compensated for prior to the step of comparing the monitored second system parameter value $P2_m$ with the minimum allowable second system parameter value $P2_0$. For example, mechanical losses in the motor 20 and/or the pump 17 may be calculated based on the rotational speed N of the pump, as is illustrated by reference numeral 33, and electrical losses may be calculated based on the power P and the pump speed N, as is illustrated by reference numeral 34.

The method finally comprises the steps of calculating a control valve control signal $S_{valve}$ based on the difference between the monitored second system parameter $P2_m$ and the minimum allowable second system parameter value $P2_0$, and using the control valve control signal $S_{valve}$ to regulate the control valve 24 such that the monitored second system parameter does not fall below the minimum allowable second system parameter value. In particular, the control valve control signal $S_{valve}$ is set to open the control valve 24 when the monitored second system parameter value $P2_m$ approaches the minimum allowable second system parameter value $P2_0$, thus preventing the second system parameter from undercutting the minimum allowable second system parameter value $P2_0$.

As previously discussed, the differential pressure over the pump 20 normally varies relatively slowly due to large volumes of hydrocarbon fluid upstream and downstream of the pump. However, the gas volume fraction and/or the density of the hydrocarbon fluid may change quickly, e.g. due to gas and/or liquid slugs in the system. Consequently, the pump torque may also changes relatively quickly. Therefore, in order to enable the system to react quickly to a change in the gas volume fraction and/or the density of the fluid, it may be advantageous to sample the second system parameter P2 using a higher sampling frequency than the first system parameter P1.

In the preceding description, various aspects of the invention have been described with reference to the illustrative embodiment. For purposes of explanation, specific numbers, systems and configurations were set forth in order to provide a thorough understanding of the invention and its workings. However, this description is not intended to be construed in a limiting sense. Various modifications and variations of the illustrative embodiment, as well as other embodiments of the apparatus, which are apparent to persons skilled in the art to which the disclosed subject matter pertains, are deemed to lie within the scope of the present invention.

The invention claimed is:

1. A method of operating a system for pumping a fluid, the system including a pump comprising a suction side and a discharge side, a motor for driving the pump, the motor being drivingly connected to the pump via a shaft, a return line providing a feed-back conduit for the fluid from the discharge side to the suction side, and a control valve for controlling the flow of the fluid through the return line, the method comprising:

establishing a pump limit characteristics diagram by mapping a first system parameter (P1) as a function of a second system parameter (P2) to identify a permissible operating region of the pump, wherein the first system parameter (P1) is a function of a differential pressure across the pump and the second system parameter (P2) is a function of a pump torque;

for each first system parameter value, identifying a minimum allowable second system parameter value ($P2_0$);

monitoring the first system parameter (P1) and identifying a minimum allowable second system parameter value ($P2_0$) corresponding to the monitored first system parameter value ($P1_m$);

monitoring the second system parameter (P2) and comparing the monitored second system parameter value ($P2_m$) with the identified minimum allowable second system parameter value ($P2_0$); and regulating the control valve based on a relationship between the monitored second system parameter value ($P2_m$) and the minimum allowable second system parameter value ($P2_0$) such that the monitored second system parameter value ($P2_m$) does not fall below the minimum allowable second system parameter value ($P2_0$);

wherein the system comprises a variable speed drive for operating the motor, and wherein the step of monitoring the second system parameter (P2) comprises sampling the second system parameter (P2) from the variable speed drive;

wherein the step of identifying a minimum allowable second system parameter value ($P2_0$) comprises compensating the minimum allowable second system parameter value ($P2_0$) for at least one of mechanical losses in at least one of the motor and the pump and electrical losses between the variable speed drive and the motor; and wherein said mechanical losses are determined based on a rotational speed of the pump and said electrical losses are determined based on a power of the pump and the rotational speed of the pump.

2. The method according to claim 1, wherein the first system parameter (P1) is a differential pressure across the pump.

3. The method according to any one of claims 1 and 2, wherein the second system parameter (P2) is a torque (T) of the pump or a current (I) in windings of the motor.

4. The method according to claim 1, wherein the step of regulating the control valve comprises opening the control valve when the monitored second system parameter value ($P2_m$) is within a predetermined range of the minimum allowable second system parameter value ($P2_0$).

5. The method according to claim 1, wherein said fluid is a hydrocarbon fluid.

6. The method according to claim 1, wherein said step of establishing a pump limit characteristics diagram comprises establishing a pump limit characteristics curve for the pump, and wherein said step of identifying a minimum allowable second system parameter value ($P2_0$) for each first system parameter value comprises establishing a pump operation curve in the permissible operating region, said pump operation curve being positioned at a predetermined distance from the pump limit characteristics curve.

7. A system for pumping a fluid, comprising:

a pump comprising a suction side and a discharge side;

a motor for driving the pump, the motor being drivingly connected to the pump via a shaft;

a return line providing a feed-back conduit for the fluid from the discharge side to the suction side;

a control valve for controlling the flow of the fluid through the return line;

a first sensor device for monitoring a first system parameter (P1) which is a function of the differential pressure across the pump;

a second sensor device for monitoring a second system parameter (P2) which is a function of a torque of the pump; and a control unit which is arranged to:

receive monitored first system parameter values ($P1_m$) from the first sensor device and, for each monitored first system parameter value ($P1_m$), identify a minimum allowable second system parameter value ($P2_0$);

receive monitored second system parameter values ($P2_m$) from the second sensor device and, for each monitored second system parameter value ($P2_m$), compare the monitored second system parameter value ($P2_m$) with the identified minimum allowable second system parameter value ($P2_0$); and regulate the control valve based on a relationship between the monitored second system parameter value ($P2_m$) and the minimum allowable second system parameter value ($P2_0$) such that the monitored second system parameter value ($P2_m$) does not fall below the minimum allowable second system parameter value ($P2_0$);

wherein the system comprises a variable speed drive for operating the motor, and wherein the control unit is arranged to monitor the second system parameter (P2) by sampling the second system parameter (P2) from the variable speed drive;

wherein the control unit is arranged to compensate the minimum allowable second system parameter value ($P2_0$) for at least one of mechanical losses in at least one of the motor and the pump and electrical losses between the variable speed drive and the motor; and wherein said mechanical losses are determined based on a rotational speed of the pump and said electrical losses are determined based on a power of the pump and the rotational speed of the pump.

8. The system according to claim 7, wherein the minimum allowable second system parameter value ($P2_0$) is identified using a pump limit characteristics diagram which maps the first system parameter (P1) as a function of the second system parameter (P2) to identify a permissible operating region of the pump.

* * * * *